US009457242B2

(12) United States Patent
Hayashi

(10) Patent No.: US 9,457,242 B2
(45) Date of Patent: Oct. 4, 2016

(54) GOLF CLUB HEAD

(71) Applicant: DUNLOP SPORTS CO. LTD., Kobe-shi, Hyogo (JP)

(72) Inventor: Kazuhiro Hayashi, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 61 days.

(21) Appl. No.: 14/446,659

(22) Filed: Jul. 30, 2014

(65) Prior Publication Data

US 2015/0038260 A1 Feb. 5, 2015

(30) Foreign Application Priority Data

Jul. 31, 2013 (JP) ..... 2013-158420

(51) Int. Cl.
*A63B 53/04* (2015.01)
*A63B 53/00* (2015.01)

(52) U.S. Cl.
CPC ..... *A63B 53/0466* (2013.01); *A63B 53/04* (2013.01); *A63B 2053/005* (2013.01); *A63B 2053/0408* (2013.01); *A63B 2053/0412* (2013.01); *A63B 2053/0462* (2013.01); *A63B 2209/00* (2013.01)

(58) Field of Classification Search
CPC ..... A63B 53/04
See application file for complete search history.

(56) References Cited

U.S. PATENT DOCUMENTS

| | | | | |
|---|---|---|---|---|
| 7,131,912 | B1 * | 11/2006 | Knuth | A63B 53/0466 473/329 |
| 8,439,769 | B2 * | 5/2013 | Rice | A63B 53/0466 473/329 |
| 2007/0054750 | A1 * | 3/2007 | Rice | A63B 60/42 473/329 |
| 2010/0273566 | A1 * | 10/2010 | Matsunaga | A63B 53/00 473/290 |
| 2013/0040752 | A1 | 2/2013 | Ashino | |

FOREIGN PATENT DOCUMENTS

| | | | |
|---|---|---|---|
| JP | 10-258142 | A | 9/1998 |
| KR | 10-2013-0018148 | A | 2/2013 |

* cited by examiner

*Primary Examiner* — Michael Dennis
(74) *Attorney, Agent, or Firm* — Birch, Stewart, Kolasch & Birch, LLP

(57) ABSTRACT

A golf club includes a hollow head 6, a shaft 8, and a grip 10. The head 6 includes a face f6. The face f6 includes a thick portion T1. The thick portion T1 includes a thick portion center point Ec. A face height at the position of the thick portion center point Ec is defined as H1, and the height of the thick portion center point Ec is defined as H2. H2/H1 is equal to or greater than 0.55. The face f6 preferably further includes secondary thick portions T2 and T3 thinner than the thick portion T1, and thin portions T4 and T5 thinner than the secondary thick portions T2 and T3. The thick portion T1 and the secondary thick portions T2 and T3 preferably form a sloped thick portion Ts extending from the upper side of a heel to the lower side of a toe.

17 Claims, 13 Drawing Sheets

GOLF CLUB HEAD

The present application claims priority on Patent Application No. 2013-158420 filed in Japan on Jul. 31, 2013, the entire contents of which are hereby incorporated by reference.

BACKGROUND OF THE INVENTION

1. Field of the Invention

The present invention relates to a golf club head.

2. Description of the Related Art

A wood type, an iron type, and a utility type, for example, are known as golf club heads. In actual play, a golf club set is used. The club set includes a plurality of golf clubs. Generally, the club set includes a wood type golf club, an iron type golf club, and a putter. In these years, many golf players are likely to use a utility type golf club.

Japanese Patent No. 5181052 (US2013/0040752) discloses a club set including a plurality of golf clubs different in the overall lengths of the clubs. In the set, the golf clubs include a head in a hollow structure. The head includes a face portion. The face portion includes a central thick portion, a toe-crown side thin portion, and a heel-sole side thin portion. In Japanese Patent No. 5181052, a toe side thin portion disposition angle θA and a heel side thin portion disposition angle θB are defined. The angles θA and θB are more increased as the overall length of the club becomes more increased.

SUMMARY OF THE INVENTION

The inventor has found that it is possible to increase a flight distance according to a technical idea different from Japanese Patent No. 5181052. It is an object of the present invention to provide a golf club excellent in a flight distance performance.

A preferred golf club includes a hollow head, a shaft, and a grip. The head includes a face. The face includes a thick portion. The thick portion includes a thick portion center point. If a face height at a position of the thick portion center point is defined as H1 and a height of the thick portion center point is defined as H2, H2/H1 is equal to or greater than 0.55.

Preferably, the face further includes a secondary thick portion thinner than the thick portion and a thin portion thinner than the secondary thick portion. Preferably, the thick portion and the secondary thick portion form a sloped thick portion extending from an upper side of a heel to a lower side of a toe.

Preferably, the head is formed by joining a head main body to a face member. Preferably, a material of the face member is rolled material. Preferably, a back surface of the face member is subjected to NC processing.

Preferably, the face member is bent after subjected to the NC processing.

Preferably, a head volume of the head is 70 $cm^3$ or greater and 150 $cm^3$ or less. Preferably, a real loft angle is 15 degrees or greater and 32 degrees or less.

A preferred club set includes a plurality of golf clubs different in club length. Each of the golf clubs includes a hollow head, a shaft, and a grip. The head includes a face. The face includes a thick portion. The thick portion includes a thick portion center point. If a face height at a position of the thick portion center point is defined as H1 and a height of the thick portion center point is defined as H2, H2/H1 is equal to or greater than 0.55.

Preferably, in the heads of the set, the face further includes a secondary thick portion thinner than the thick portion and a thin portion thinner than the secondary thick portion. Preferably, the thick portion and the secondary thick portion form a sloped thick portion extending from an upper side of a heel to a lower side of a toe. Preferably, a tilt angle θ of the sloped thick portion is increased as a club length becomes shorter.

DESCRIPTION OF THE PREFERRED EMBODIMENT

In the following, the present invention will be described in detail based on preferred embodiments with appropriate reference to the drawings.

Figure 1:
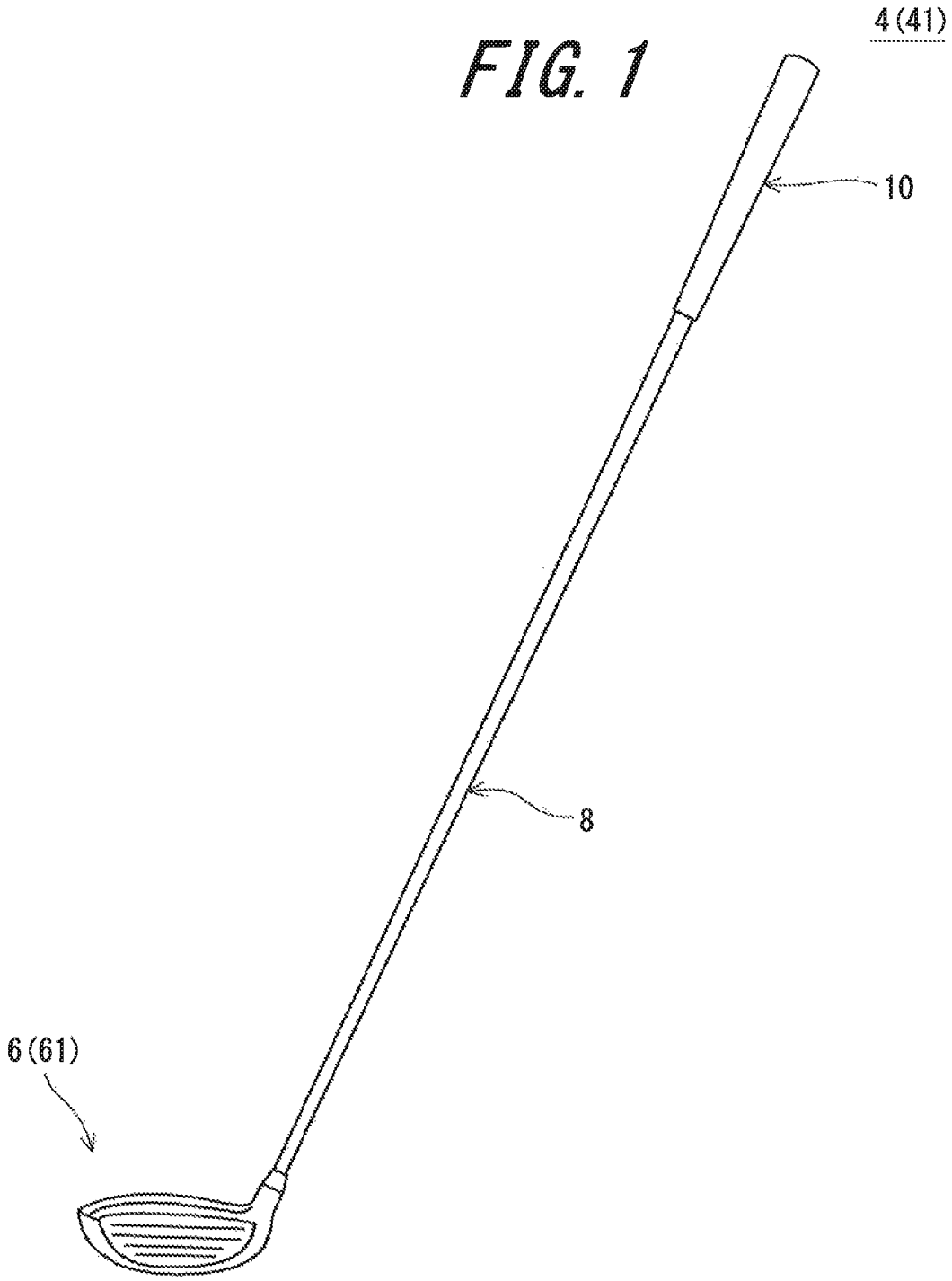
FIG. 1 shows a golf club according to an embodiment of the present invention.

A golf club 4 illustrated in FIG. 1 includes a head 6, a shaft 8, and a grip 10.

FIG. 1 is an example of a golf club set 2 including the golf club 4. The set 2 includes a plurality of the golf clubs 4. The set 2 according to the embodiment includes five golf clubs 4. Each of the golf clubs 4 includes the head 6, the shaft 8, and the grip 10. The club length is different in each of the clubs 4. The length of the shaft 8 is different in each of the clubs 4. The loft angle of the head 6 is different in each of the clubs 4.

The number of the clubs 4 in the set 2 is equal to or greater than two, preferably equal to or greater than three, and more preferably equal to or greater than four. In consideration of the restriction of the number of the clubs according to the golf rules, the number of the clubs 4 in the set 2 is preferably equal to or less than seven, more preferably equal to or less than six, and more preferably equal to or less than five.

All the heads 6 are hollow. All the heads 6 are hollow heads, which are not drivers (number 1 woods).

It is noted that as illustrated in FIG. 1, the head 6 includes a plurality of face lines (face grooves). In the drawings other than FIG. 1, the face lines are omitted.

The type of the head is not limited. For example, the head 6 may be a wood type, a utility type (hybrid type), or an iron type. In the embodiment, all the heads 6 are utility heads.

The set 2 includes a club 41, a club 42, a club 43, a club 44, and a club 45 in ascending order of a loft angle. The loft angle of the club 41 is the smallest in the set 2. The loft angle of the club 45 is the greatest in the set 2. It is noted that the loft angle means a real loft angle.

Figure 2:
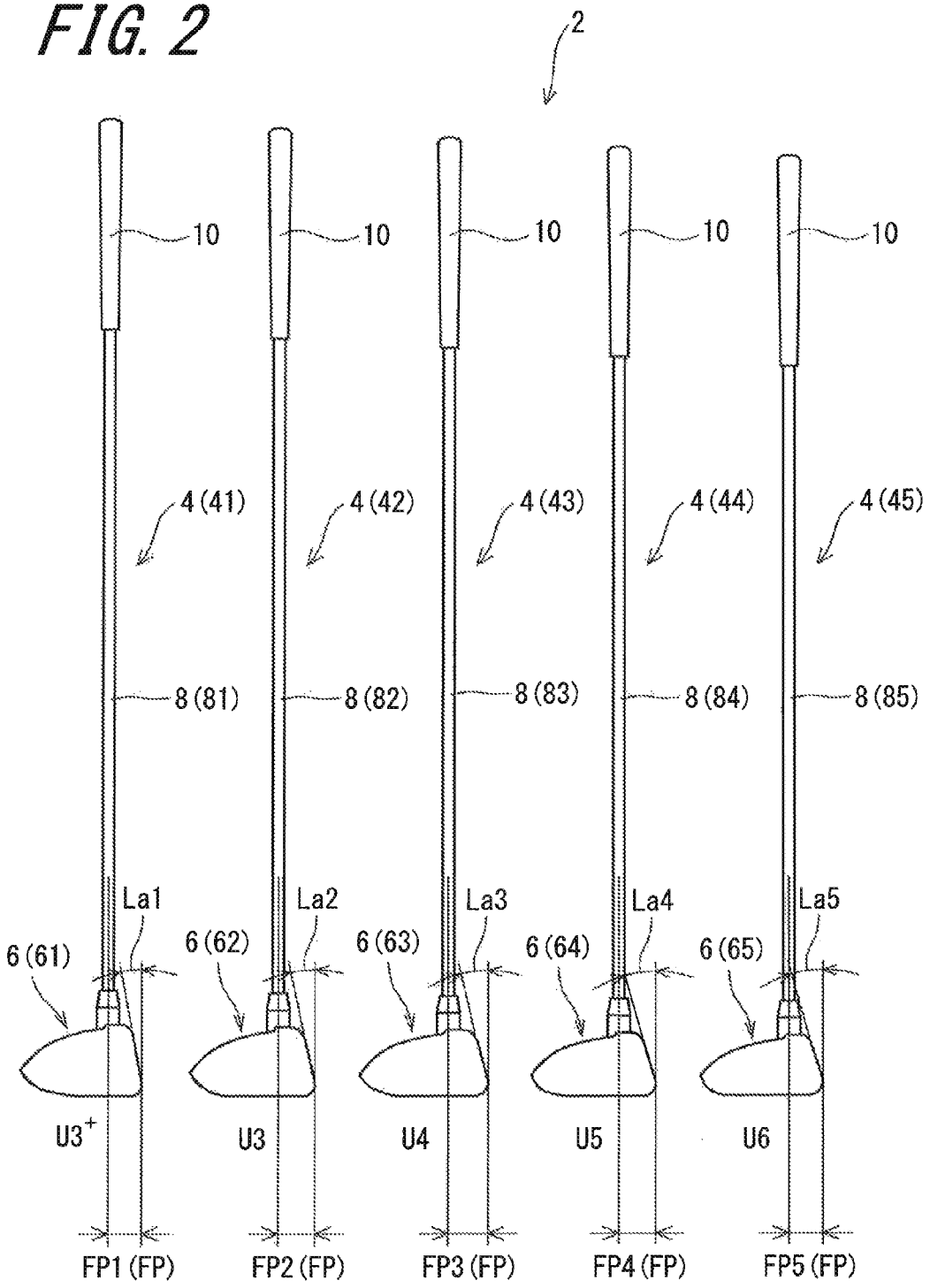
FIG. 2 shows a golf club set according to an embodiment of the present invention.

As illustrated in FIG. 2, a two-directional arrow La1 expresses the loft angle of the club 41. A two-directional arrow La2 expresses the loft angle of the club 42. A two-directional arrow La3 expresses the loft angle of the club 43. A two-directional arrow La4 expresses the loft angle of the club 44. A two-directional arrow La5 expresses the loft angle of the club 45. The loft angles are La1, La2, La3, La4, and La5 in ascending order. That is, La1<La2<La3<La4<La5. The loft angle is greater, as the club length is smaller.

In the embodiment, the loft angle La1 is equal to or greater than 16 degrees and equal to or less than 18 degrees. In the embodiment, the loft angle La2 is greater than 18 degrees and equal to or less than 20 degrees. In the embodiment, the loft angle La3 is greater than 20 degrees and equal to or less than 22 degrees. In the embodiment, the loft angle La4 is greater than 22 degrees and equal to or less than 24 degrees. In the embodiment, the loft angle La5 is greater than 24 degrees and equal to or less than 26 degrees. A preferred golf club set includes two kinds or greater of these five kinds of loft angles, and more preferably three kinds or greater of these five kinds of loft angles.

In the present application, the loft angles of N clubs configuring the set 2 are defined as La1, La2 . . . LaN in ascending order of a loft angle, where N is a natural number of 2 or greater. In the embodiment, N is 5. The set 2 satisfies La1<La2<. . . <LaN.

In the embodiment, the smallest loft angle La1 in the set is preferably equal to or greater than 15 degrees, and more preferably equal to or greater than 16 degrees. The set 2 does not include a driver (a number 1 wood).

In the set 2, the head volume is smaller, as the loft angle is greater. In the set 2, the head weight is greater, as the loft angle is greater.

The club 41 includes a head 61 and a shaft 81. The club 42 includes a head 62 and a shaft 82. The club 43 includes a head 63 and a shaft 83. The club 44 includes a head 64 and a shaft 84. The club 45 includes a head 65 and a shaft 85.

In the set 2, the shaft is shorter, as the loft angle is greater. The shaft lengths are the shaft 81, the shaft 82, the shaft 83, the shaft 84, and the shaft 85 in ascending order. In the set 2, the club length is smaller, as the loft angle is greater. The club length of the club 41 is the longest in the set 2. The club length of the club 45 is the shortest in the set 2.

The club length is changed by 0.5 inches per number. That is, in the set 2, the club length is changed by a pitch of 0.5 inch. In the embodiment, the club length of the club 41 is 41 inches. In the set 2, the club 41 is the longest. The club length of the club 42 is 40.5 inches. The club length of the club 43 is 40 inches. The club length of the club 44 is 39.5 inches. The club length of the club 45 is 39 inches. In the set 2, the club 45 is the shortest. In the set 2, the club length of the longest club is preferably 40.5 inches or greater and 41.5 inches or less. In the set 2, the club length of the shortest club is preferably 38.5 inches or greater and 39.5 inches or less.

In FIG. 2, a face progression FP is displayed on each of the clubs 4. A two-directional arrow FP1 expresses the face progression FP of the club 41. A two-directional arrow FP2 expresses the face progression FP of the club 42. A two-directional arrow FP3 expresses the face progression FP of the club 43. A two-directional arrow FP4 expresses the face progression FP of the club 44. A two-directional arrow FP5 expresses the face progression FP of the club 45. Generally, the face progression FP is greater, as the club length is shorter.

Each of the heads 6 is added with characters expressing a club number. Practically, the characters are displayed on a sole s6, for example. UT3$^{+}$is displayed on the golf club 41. UT3 are displayed on the golf club 42. UT4 are displayed on the golf club 43. UT5 are displayed on the golf club 44. UT6 are displayed on the golf club 45.

Figure 3:
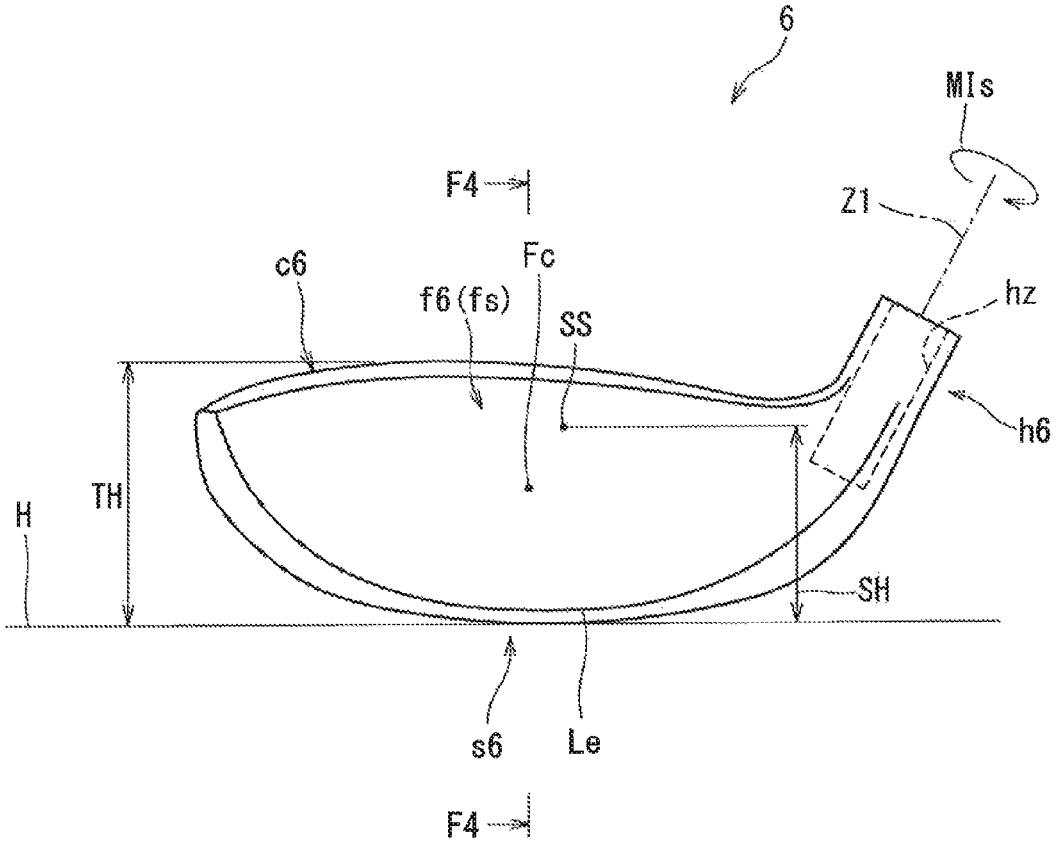
FIG. 3 is a front view of a head according to an embodiment of the present invention.
Figure 4:
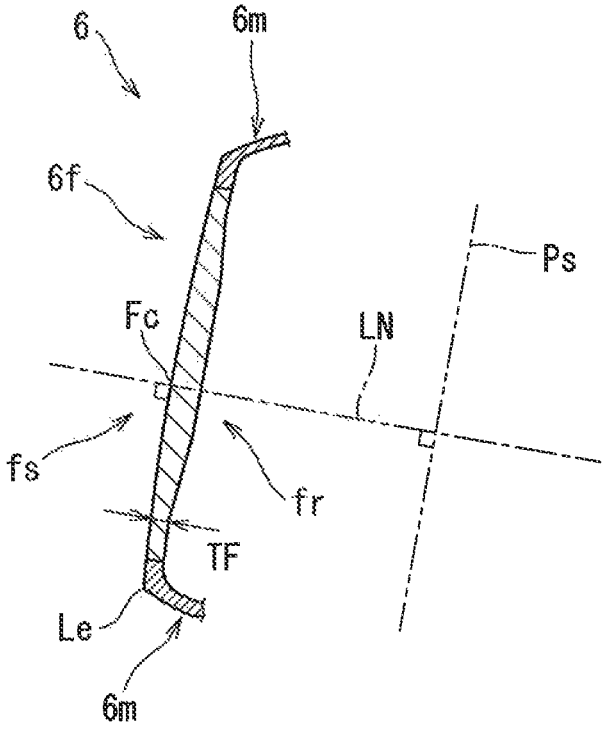
FIG. 4 is a cross-sectional view taken along line F4-F4 in FIG. 3.

FIG. 3 is a front view of the head 6. FIG. 4 is a cross-sectional view taken along line F4-F4 in FIG. 3. In FIG. 4, only portions around the face are illustrated.

In the present application, matters described for the head 6 are in common with all the heads 61 to 65.

The head 6 includes a face f6, a crown c6, a sole s6, and a hosel h6. The face f6 includes a face surface fs and a face back surface fr. The face surface fs is the outer surface of the face f6. The face surface fs is a hitting surface. The face back surface fr is the inner surface of the face f6. The head 6 is hollow. The hosel h6 includes a hosel hole hz. A shaft axis Z1 is matched with the center axis line of the hosel hole hz.

In the head 6, the inertia moment MIs about the shaft axis Z1 is measured. The inertia moment MIs can be set for each club number.

The face surface fs includes a face center Fc. The face surface fs includes a sweet spot SS. The face surface fs includes a leading edge Le. The leading edge Le is the lower edge of the face surface fs.

The face surface fs is a three-dimensional curved surface projecting to the outer side. Similarly to a typical wood head, the face surface fs includes a bulge and a roll.

[Definition of Terms]

The terms in the present application are defined as follows.

[Reference State and Reference Vertical Plane]

A reference state is defined as a state in which the center axis line Z1 of the shaft hole is included in a plane VP1 perpendicular to a horizontal plane H and the head is placed on the horizontal plane H at a specified lie angle and real loft angle. The plane VP1 is defined as a reference vertical plane. The specified lie angles and real loft angles are described in product catalogs, for example. FIG. 3 illustrates the head 6 in the reference state.

[Toe-Heel Direction]

The toe-heel direction is defined as the direction of an intersection line of the reference vertical plane VP1 and the horizontal plane H.

[Face-Back Direction]

The face-back direction is defined as a direction perpendicular to the toe-heel direction and parallel with the horizontal plane H.

[Vertical Direction]

The vertical direction is defined as a direction perpendicular to the horizontal plane H.

[Face Center Fc]

A maximum width Wx (not illustrated in the drawing) of the toe-heel direction is determined on the face surface fs. Moreover, a toe-heel direction center position Px in the maximum width Wx is determined. A vertical direction center point Py on the face surface is determined at the position Px. The point Py is defined as the face center Fc.

[Projection Plane Ps]

In FIG. 4, a projection plane Ps is expressed by a long dashed double-short dashed line. The projection plane Ps is a plane perpendicular to a linear line LN. The linear line LN is a linear line passed through the face center Fc and perpendicular to the face surface fs. It is noted that the direction of the linear line LN is defined as the face normal direction.

[Planar View]

A planar view is defined as a projection image onto the projection plane Ps. It is noted that in projection onto the projection plane Ps, the direction of the projection is the face normal direction.

[Upward and Downward Direction]

A linear line extending in the vertical direction is projected onto the projection plane Ps. An upward and downward direction is defined as the direction of the linear line on the projected projection plane Ps. The upward and downward direction is in parallel with the projection plane Ps. Based on the upward and downward direction, "the upper side" and "the lower side" are determined in the planar view. The upward and downward direction is nearly parallel to the face surface fs.

[Head Height]

FIG. 3 illustrates a head height TH. The head height TH is the maximum height of the crown c6. The head height TH is measured in the reference state. The head height TH is defined as the height from the horizontal plane H. The head height TH is measured along the vertical direction.

[Sweet Spot Height SH]

In the head in the reference state, the height of the sweet spot SS from the horizontal plane H is a sweet spot height SH (see FIG. 3). The sweet spot height SH is measured along the vertical direction. It is noted that the sweet spot SS is an intersection point of the face surface fs and a perpendicular line from the center of gravity of a head to the face surface.

[Face Progression FP]

In the head in the reference state, the face progression FP is a face-back direction distance between the frontmost point of the head 6 and the plane VP1. The frontmost point of the head is a point closest to the face side in the face-back direction. The face progression FP is appropriately set for each club number.

[Edge of the Face Surface fs]

The face surface is defined as a region surrounded by an edge in the case where the edge can be visually identified as a clear edge line or the like. In the case where the edge is unclear because of a round shape or the like, a large number of planes are assumed including a linear line L1 (not illustrated) connecting the center of gravity of the head to the sweet spot SS. A curvature radius r of the head outer surface is measured on cross sections along these planes. The curvature radius r is continuously measured from the face center Fc toward the outward direction. In the continuous measurement, the edge is defined as a point at which the curvature radius r first becomes 200 mm or less. In the measurement of the curvature radius r, it is assumed that a face line, a punch mark, or the like does not exist.

Figure 5:
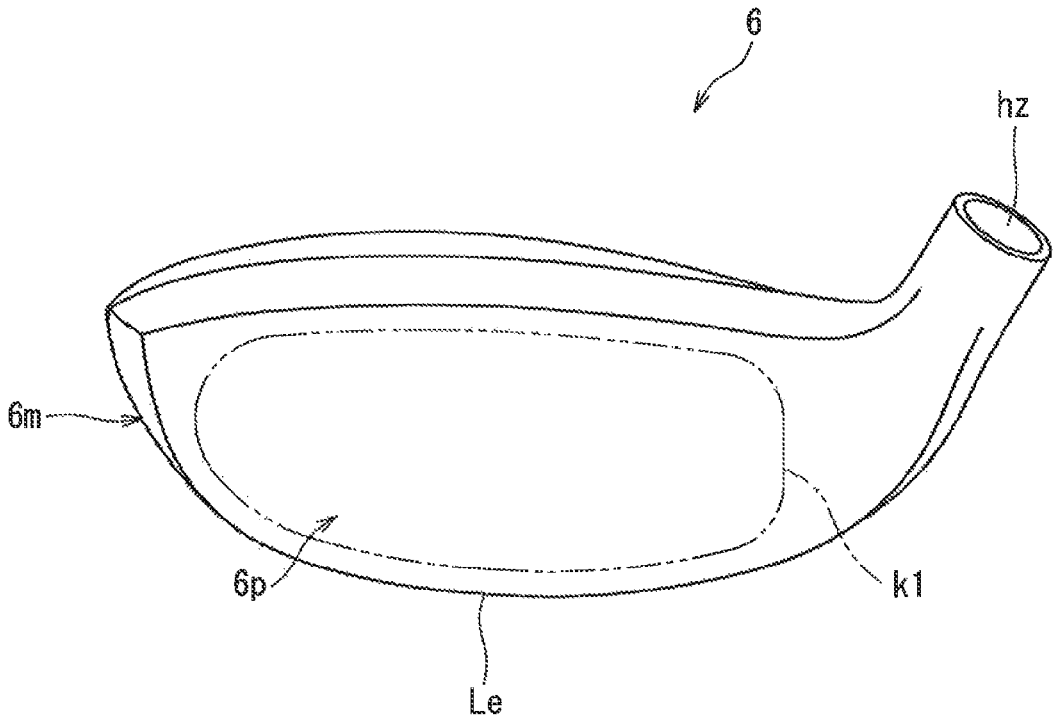
FIG. 5 is a perspective view of the head in FIG. 3.
Figure 6:
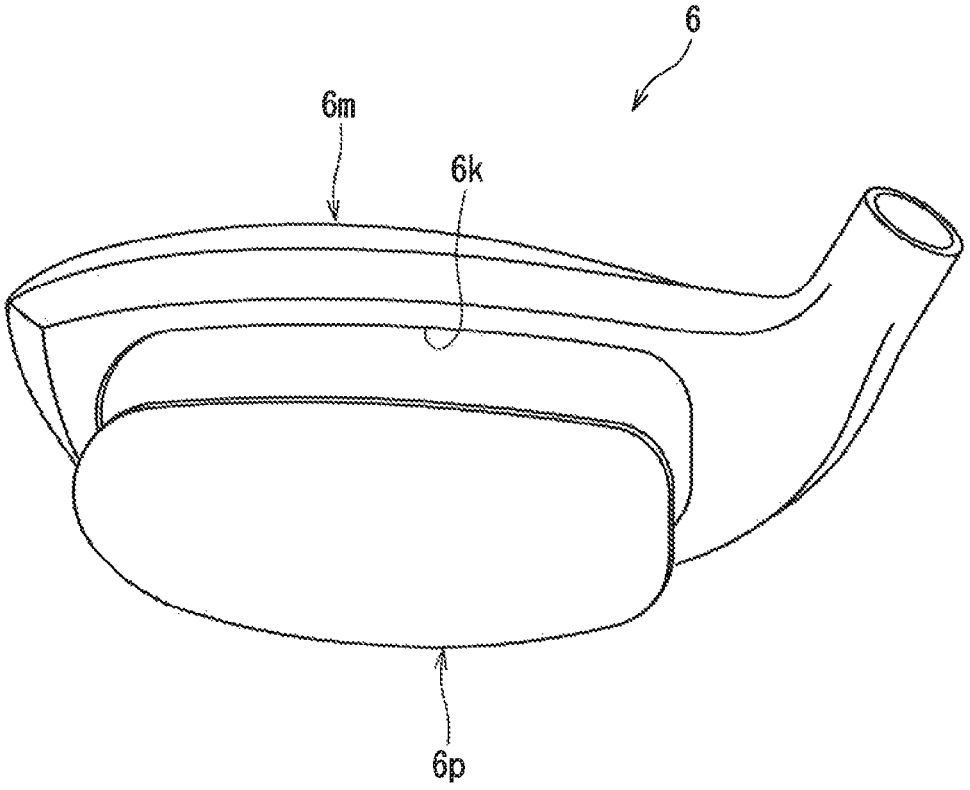
FIG. 6 is an exploded view of the head in FIG. 3.

FIG. 5 is a perspective view of the head 6. FIG. 6 is an exploded perspective view of the head 6. As illustrated in FIG. 6, the head 6 is formed by joining a head main body 6*m* to a face member 6*p*. The joining is welding. The head main body 6*m* includes an opening 6*k*. The shape of the opening 6*k* corresponds to the outline shape of the face member 6*p*. The opening 6*k* is closed by the face member 6*p*. In FIG. 5, a long dashed double-short dashed line expresses a boundary k1 between the head main body 6*m* and the face member 6*p*.

In the entire area of the face surface fs, a ratio Rp of the area formed by the face member 6*p* is preferably equal to or greater than 60%, more preferably equal to or greater than 70%, and still more preferably equal to or greater than 80%. In the case where the face member 6*p* is formed of a plate member, the face member 6*p* may be formed in a plate shape. Therefore, the edge portion of the face surface fs may be formed of the head main body 6*m*. From this viewpoint, the ratio Rp is preferably equal to or less than 95%, and more preferably equal to or less than 90%.

The face member 6*p* is in a plate shape. The face member 6*p* forms a part of the face f6. The face member 6*p* forms the center part of the face f6. The head main body 6*m* forms a portion around the face f6. The head main body 6*m* forms the face f6 around the face member 6*p*. With this configuration, the face member 6*p* is allowed to be formed in a plate shape.

The material of the head main body 6*m* is not limited. The material of the head main body 6*m* includes a metal, CFRP (carbon fiber reinforced plastic), or the like. The metal includes one kind or more of metals selected from pure titanium, a titanium alloy, stainless steel, maraging steel, an aluminum alloy, a magnesium alloy, and a tungsten-nickel alloy. Stainless steel includes SUS 630 and SUS 304. A specific example of stainless steel includes CUSTOM 450 (made by Carpenter Technology Corporation). A titanium alloy includes 6-4 titanium (Ti-6Al-4V), Ti-15V-3Cr-3Sn-3Al, or the like.

The material of the face member 6*p* is not limited. From the viewpoint of strength, a preferred material includes a titanium alloy and maraging steel, and maraging steel is more preferable. Preferred maraging steel includes Custom 455 and HT 1770. The material of the face member 6*p* according to the embodiment is Custom 455.

The head main body 6*m* is manufactured by casting. The face member 6*p* is manufactured by pressing a plate member. The plate member is a flat plate. The plate member is rolled material (rolled steel). Rolled material has few defects and is excellent in strength. Moreover, rolled material has high accuracy of the thickness. The accuracy of the thickness of the face f6 is improved by using rolled material. The strength the face f6 is improved by using rolled material.

Another preferred material of rolled material is forged steel. Forged steel also has few defects and is excellent in strength. From the viewpoint of strength, the material of the face member 6*p* is preferably rolled material or forged steel, and rolled material is more preferable.

As described above, the face surface fs is a three-dimensional curved surface including a bulge and a roll. Accordingly, in the case where a flat plate is used for a material, the flat plate is bent.

The face back surface fr of the face member 6*p* is formed by NC processing. By NC processing, a thickness TF is highly accurately formed. NC stands for "Numerical Control". More specifically, the face back surface fr is formed by CNC processing. CNC stands for "Computerized Numerical Control". The accuracy of the thickness TF is high.

The manufacturing process of the face member 6*p* include Steps A, B, and C below.

(1) Step A in which a flat plate is subjected to NC processing.
(2) Step B in which the flat plate is cut into the outline shape of the face member 6*p*.
(3) Step C in which members subjected through Step A and Step B are bent.

The process in Step B is preferably performed by NC processing. Moreover, NC data in Step A is preferably associated with NC data in Step B. In this case, the distribution of the thickness TF can be highly accurately formed.

The process in Step C (bending) is performed by pressing. The pressing is cold pressing. By cold pressing, the thickness TF formed by NC processing is unlikely to change during pressing. Therefore, the accuracy of the thickness TF is improved.

In this manner, the face member 6*p* is manufactured by being bent after NC processing is applied to the flat plate. NC processing is applied to the flat plate, and thereby the accuracy of the thickness TF is improved. In the case where NC processing is performed after bending, errors in bending are not reflected to NC data, and the accuracy of the thickness TF can be degraded as a consequence.

Moreover, the flat plate is rolled material. NC processing is applied to rolled material excellent in the accuracy of the thickness, so that the thickness distribution can be accurately formed.

Figure 7:
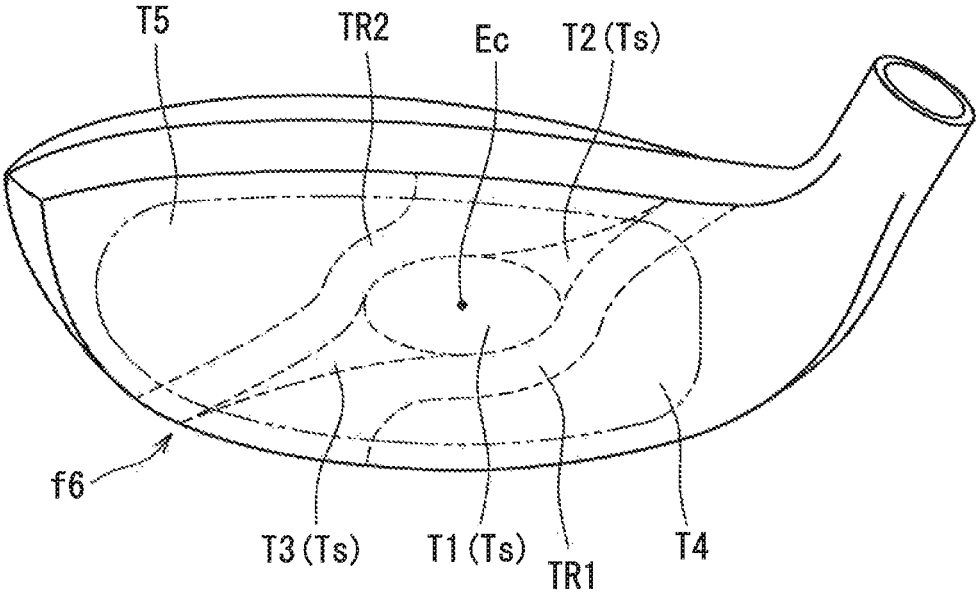
FIG. 7 is a perspective view the same as FIG. 5, in which the edge lines of a face back surface are depicted in broken lines.

FIG. 7 is a view for explaining the thickness distribution of the face f6. In FIG. 7, broken lines express edge lines formed on the face back surface fr. The face back surface fr is continued overall without a step. However, a large number of narrow streaks (not illustrated in the drawing) are formed on the face back surface fr. These streaks are marks of milling.

The face f6 includes a first thick portion T1. In the embodiment, the first thick portion T1 is an elliptical region. The thick portion T1 includes a face center Fc. Moreover, the face f6 includes a second thick portion T2 and a third thick portion T3. The second thick portion T2 is thinner than the first thick portion T1. The third thick portion T3 is thinner than the first thick portion T1.

In the present application, the first thick portion T1 is also simply referred to as a thick portion. In the present application, the second thick portion T2 and the third thick portion T3 are also referred to as secondary thick portions.

The face f6 includes a sloped thick portion Ts. The sloped thick portion Ts is formed of the thick portion T1 and the secondary thick portions T2 and T3. The sloped thick portion Ts extends from the upper side of the heel to the lower side of the toe.

The secondary thick portions T2 and T3 thinner than the thick portion T1 reduce the region of the thick portion T1, and the rebound performance can be improved. Moreover, the secondary thick portions T2 and T3 extending in ribs improve the face strength.

The second thick portion T2 is adjacent to the thick portion T1. The second thick portion T2 extends from the thick portion T1 to the heel side and to the upper side. In the embodiment, the width of the second thick portion T2 is gradually reduced toward the heel side. The tip end of the second thick portion T2 is tapered. The third thick portion T3 is adjacent to the thick portion T1. The third thick portion T3 extends from the thick portion T1 to the toe side and to the lower side. In the embodiment, the width of the third thick portion T3 is gradually reduced toward the toe side. The tip end of the third thick portion T3 is tapered.

The face f6 includes a thin portion. The thin portion includes a heel thin portion T4 and a toe thin portion T5. The heel thin portion T4 is thinner than the thick portion T1. The heel thin portion T4 is thinner than the second thick portion T2 (the secondary thick portion). The heel thin portion T4 is thinner than the third thick portion T3 (the secondary thick portion). The toe thin portion T5 is thinner than the thick portion T1. The toe thin portion T5 is thinner than the second thick portion T2 (the secondary thick portion). The toe thin portion T5 is thinner than the third thick portion T3 (the secondary thick portion).

The heel thin portion T4 is thinner than the sloped thick portion Ts. The heel thin portion T4 is an example of a thin portion. The toe thin portion T5 is thinner than the sloped thick portion Ts. The toe thin portion T5 is an example of a thin portion.

As illustrated in FIG. 7, the sloped thick portion Ts transverses the face member 6*p*. The sloped thick portion Ts contributes to the improvement of the face strength while accepting the existence of the thin portions T4 and T5.

The face f6 includes a transitional portion. The transitional portion is located between the sloped thick portion Ts and the thin portions T4 and T5. The transitional portion connects the sloped thick portion Ts to the thin portions T4 and T5 without a step. In the embodiment, the transitional portion includes a first transitional portion TR1 and a second transitional portion TR2. The first transitional portion TR1 is located between the sloped thick portion Ts and the heel thin portion T4. The first transitional portion TR1 is adjacent to the heel thin portion T4. The first transitional portion TR1 is adjacent to the thick portion T1. The first transitional portion TR1 is adjacent to the sloped thick portion Ts. The second transitional portion TR2 is located between the sloped thick portion Ts and the toe thin portion T5. The second transitional portion TR2 is adjacent to the toe thin portion T5. The second transitional portion TR2 is adjacent to the thick portion T1. The second transitional portion TR2 is adjacent to the sloped thick portion Ts.

The first transitional portion TR1 extends from the upper side of the heel to the lower side of the toe. The thickness of the first transitional portion TR1 is between the thickness of the sloped thick portion Ts and the thickness of the heel thin portion T4. The thickness of the first transitional portion TR1 is gradually reduced from the sloped thick portion Ts to the heel thin portion T4.

The second transitional portion TR2 extends from the upper side of the heel to the lower side of the toe. The thickness of the second transitional portion TR2 is between the thickness of the sloped thick portion Ts and the thickness of the toe thin portion T5. The thickness of the second transitional portion TR2 is gradually reduced from the sloped thick portion Ts to the toe thin portion T5.

The heel thin portion T4 is thinner than the transitional portions TR1 and TR2. The toe thin portion T5 is thinner than the transitional portions TR1 and TR2.

The thickness TF of the first thick portion T1 is at the maximum on the face member 6*p*. The thickness TF of the first thick portion T1 is at the maximum on the face f6. However, it is considered that a portion whose difference is within 0.02 mm from the maximum thickness is also the thick portion T1.

As illustrated in FIG. 7, the face member 6*p* includes the entire thick portion T1. The face member 6*p* includes at least a part of the secondary thick portions T2 and T3. The face member 6*p* includes at least a part of the heel thin portion T4. The face member 6*p* includes at least a part of the toe thin portion T5. The face member 6*p* includes at least a part of the first transitional portion TR1. The face member 6*p* includes at least a part of the second transitional portion TR2.

In the embodiment, the following is the thickness TF of each portion.

The first thick portion T1: 2.15 mm

The second thick portion T2: 1.7 mm or greater and less than 2.15 mm

The third thick portion T3: 1.6 mm or greater and less than 2.15 mm

The heel thin portion T4: 1.5 mm

The toe thin portion T5: 1.6 mm

In the embodiment, the difference in the thickness between the thick portion T1 and the secondary thick portions T2 and T3 is equal to or less than 0.55 mm.

From the viewpoint of the strength of the face, the thickness of the first thick portion T1 is preferably equal to or greater than 1.9 mm, and more preferably equal to or greater than 2.0 mm. From the viewpoint of the rebound performance, the thickness of the first thick portion T1 is preferably equal to or less than 2.4 mm, and more preferably equal to or less than 2.3 mm.

From the viewpoint of the strength of the face, the average thicknesses of the secondary thick portions T2 and T3 are preferably equal to or greater than 1.5 mm, and more preferably equal to or greater than 1.6 mm. From the viewpoint of the rebound performance, the average thicknesses of the secondary thick portions T2 and T3 are preferably equal to or less than 2.2 mm, and more preferably equal to or less than 2.1 mm.

From the viewpoint of the strength of the face, the average thicknesses of the thin portions T4 and T5 are preferably equal to or greater than 1.3 mm, and more preferably equal to or greater than 1.4 mm. From the viewpoint of the rebound performance, the average thicknesses of the thin portions T4 and T5 are preferably equal to or less than 1.8 mm, and more preferably equal to or less than 1.7 mm.

FIG. 7 illustrates a thick portion center point Ec. In a planar view, the center of a figure of the thick portion T1 can be determined. The center of the figure in a planar view is the thick portion center point Ec. In the embodiment, the thick portion center point Ec is the center of an ellipse which is the outline of the thick portion T1.

Figure 8:
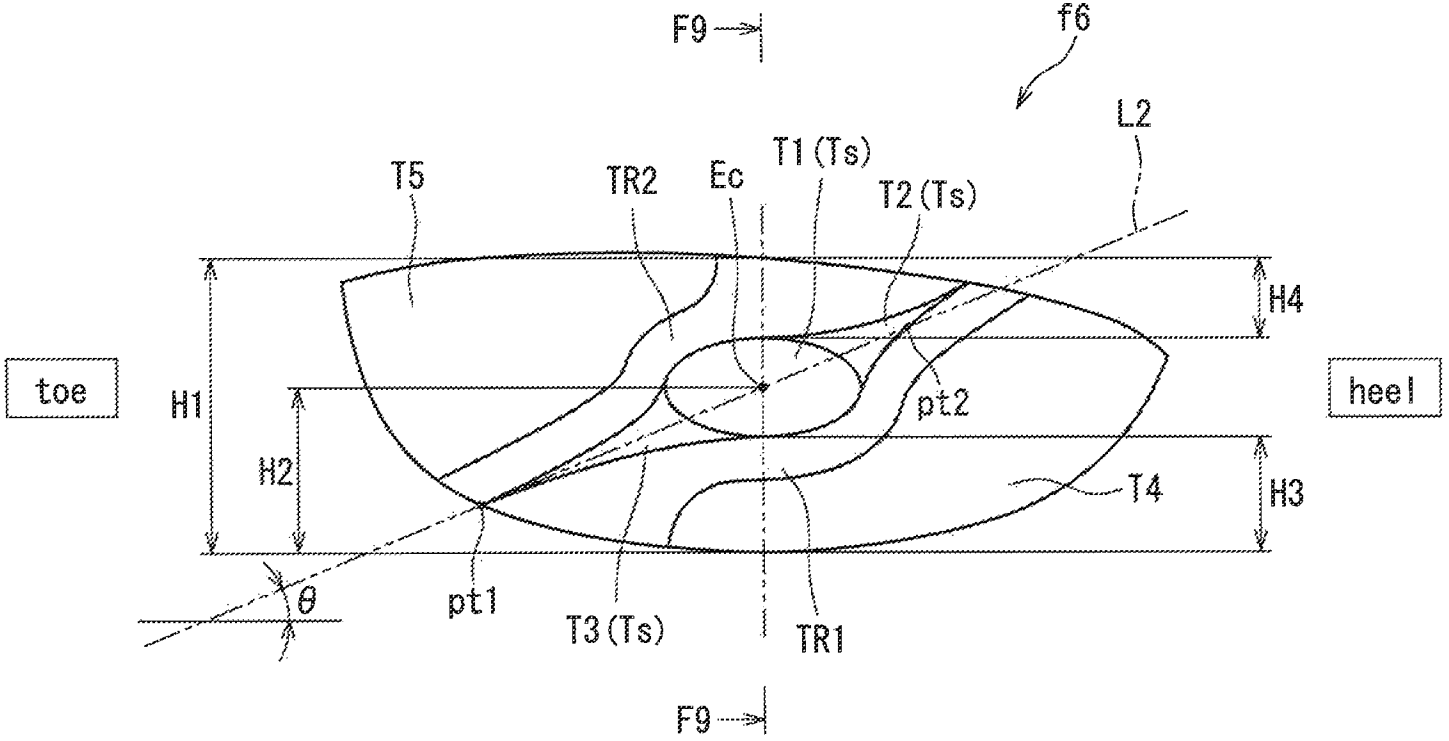
FIG. 8 is a plan view of the portions of a face, illustrating a planar view of the face.
Figure 9:
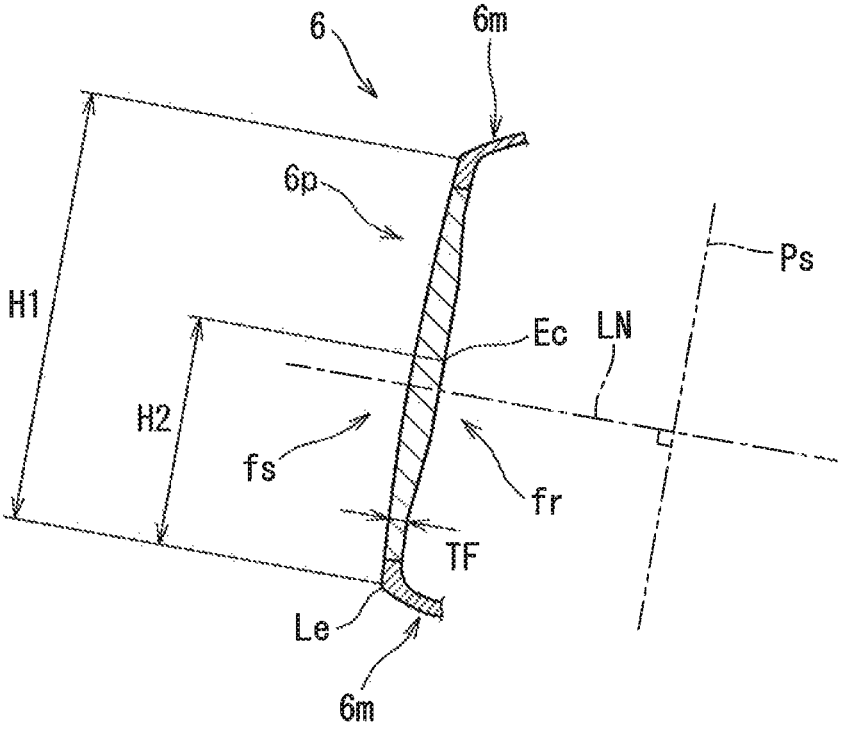
FIG. 9 is a cross-sectional view of the head taken along line F9-F9 in FIG. 8.

FIG. 8 is the face f6 in a planar view. FIG. 9 is a cross-sectional view of the head 6 taken along cross section line F9-F9 in FIG. 8. The cross section line F9-F9 is passed through the thick portion center point Ec.

Solid boundary lines illustrated in FIG. 8 are edge lines visually recognized on the face back surface fr. These boundary lines are not visually recognized from the face surface fs side. Therefore, the solid boundary lines in FIG. 8 should be originally expressed by broken lines. In FIG. 8, in order to clarify the boundary lines, the boundary lines, which should be shown by broken lines, are expressed by solid lines. A plan view of the actual face back surface fr is one that FIG. 8 is transversely inverted.

In FIGS. 8 and 9, a two-directional arrow H1 expresses the face height at the position (the position in the toe-heel direction) of the thick portion center point Ec. The height H1 is measured in the planar view. The height H1 is measured along the foregoing upward and downward direction. The starting point of the height H1 is the lower edge of the face surface fs. The lower edge is the leading edge Le. The end point of the height H1 is the upper edge of the face surface fs.

In FIGS. 8 and 9, a two-directional arrow H2 expresses the height of the thick portion center point Ec. The height H2 is also measured at the position of the thick portion center point Ec (the position in the toe-heel direction). The height H2 is measured in the planar view. The height H2 is measured along the foregoing upward and downward direction. The starting point of the height H2 is the lower edge of the face surface fs. The end point of the height H2 is the thick portion center point Ec.

As illustrated in FIG. 8, the sloped thick portion Ts extends from the upper side of the heel to the lower side of the toe. The sloped thick portion Ts extending from the upper side of the heel to the lower side of the toe is formed of the thick portion T1 and the secondary thick portions T2 and T3.

The thin portions T4 and T5 are easily secured on the lower side of the heel and on the upper side of the toe by extending the sloped thick portion Ts from the upper side of the heel to the lower side of the toe. As a result of analyzing the hitting points of a large number of golf players, many hitting points of ordinary golf players were distributed relatively on the lower side of the heel and on the upper side of the toe. The thin portions T4 and T5 on the lower side of the heel and on the upper side of the toe can contribute to the improvement of the average flight distance.

[Face Height H1]

In the case where a ball directly placed on the lawn is hit, an excessively high height H1 is not preferable. In consideration of this point, the height H1 is preferably equal to or less than 40 mm, more preferably equal to or less than 38 mm, and still more preferably equal to or less than 36 mm. The thin region other than the thick portion T1 can improve the rebound performance. From this viewpoint, the height H1 is preferably equal to or greater than 29 mm, more preferably equal to or greater than 30 mm, still more preferably equal to or greater than 31 mm, and yet more preferably equal to or greater than 32 mm. The preferred range of the height H1 is preferably satisfied in all the clubs of the set 2.

In the set 2, the height H1 is greater as the club length becomes shorter. In the set 2, an appropriate height H1 is set for individual numbers as corresponding to an increase in the loft angle. Therefore, as the entire set 2, the ease of taking a swing and the flight distance performance can be achieved.

[Height H2 of the Thick Portion Center Point]

In the case where a ball directly placed on the lawn is hit, the hitting point is likely to be located on the lower side. The height H2 is increased, so that the rebound performance can be improved in the case where the hitting point is located on the lower side. From this viewpoint, the height H2 is preferably equal to or greater than 16 mm, more preferably equal to or greater than 17 mm, and still more preferably equal to or greater than 18 mm. In the case where the height H2 is excessively great, the strength of the face is sometimes degraded. From this viewpoint, the height H2 is preferably equal to or less than 22 mm, more preferably equal to or less than 21 mm, and still more preferably equal to or less than 20 mm. The preferred range of the height H2 is preferably satisfied in all the clubs of the set 2.

In the set 2, the height H2 is greater as the club length is shorter. In the set 2, an appropriate height H2 is set for each club number for corresponding to an increase in the loft angle. Therefore, as the entire set 2, a great flight distance can be obtained.

[H2/H1]

From the viewpoint of the rebound performance in the case where the hitting point is located on the lower side, H2/H1 is preferably equal to or greater than 0.55, and more preferably equal to or greater than 0.56. In consideration of the strength of the face, H2/H1 is preferably equal to or less than 0.63, and more preferably equal to or less than 0.60. The preferred range of the height H2/H1 is preferably satisfied in all the clubs of the set 2.

Conventionally, it is considered that lowering the sweet spot height SH contributes to increase the flight distance. An increase in the height H2 of the thick portion center point tends to heighten the sweet spot height SH. Because of this, conventionally, the height H2 of the thick portion center point is not increased. Conventionally, H2/H1 is made smaller.

[Face Height H3 Located on the Lower Side with Respect to the Thick Portion]

In FIG. 8, a two-directional arrow H3 expresses the face height located on the lower side with respect to the thick portion T1. The height H3 is also the face height located on the lower side with respect to the sloped thick portion Ts. The height H3 is measured at the position in the toe-heel direction of the thick portion center point Ec. The height H3 is measured in the planar view. The height H3 is measured in the upward and downward direction.

From the viewpoint of the rebound performance in the case where the hitting point is located on the lower side, the height H3 is preferably equal to or greater than 7 mm, more preferably equal to or greater than 9 mm, and still more preferably equal to or greater than 11 mm. From the viewpoint of the strength of the face, the height H3 is preferably equal to or less than 19 mm, more preferably equal to or less than 17 mm, and still more preferably equal to or less than 15 mm. The preferred range of the height H3 is preferably satisfied in all the clubs of the set 2.

[Face Height H4 Located on the Upper Side with Respect to the Thick Portion]

In FIG. 8, a two-directional arrow H4 expresses the face height located on the upper side with respect to the thick portion T1. The height H4 is also the face height located on the upper side with respect to the sloped thick portion Ts. The height H4 is measured at the position in the toe-heel direction of the thick portion center point Ec. The height H4 is measured in the planar view. The height H4 is measured in the upward and downward direction.

[H3/H4]

From the viewpoint of securing the rebound performance in the case where the hitting point is located on the lower side, H3/H4 is preferably equal to great than 1.0, more preferably equal to or greater than 1.1, and still more preferably equal to or greater than 1.2. From the viewpoint of improving the face strength, H3/H4 is preferably equal to or less than 1.8, more preferably equal to or less than 1.7, and still more preferably equal to or less than 1.6. The preferred range of the height H3/H4 is preferably satisfied in all the clubs of the set 2.

[H2−H3]

From the viewpoint of improving the face strength, the difference (H2−H3) is preferably equal to or greater than 2 mm, more preferably equal to or greater than 3 mm, and still more preferably equal to or greater than 4 mm. From the viewpoint of improving the rebound performance, the difference (H2−H3) is preferably equal to or less than 9 mm, more preferably equal to or less than 8 mm, and still more preferably equal to or less than 7 mm. The preferred range of the difference (H2−H3) is preferably satisfied in all the clubs of the set 2.

[Toe-Heel Direction Distance between the Thick Portion Center Point Ec and the Face Center Fc]

From the viewpoint of the strength of the face, the position in the toe-heel direction of the thick portion center point Ec is preferably close to the face center Fc. From this viewpoint, the toe-heel direction distance between the point Ec and the face center Fc is preferably equal to or less than 5 mm, more preferably equal to or less than 4 mm, and still more preferably equal to or less than 3 mm. This distance may be zero. The preferred distance is preferably satisfied in all the clubs of the set 2.

[Area Ratio Ra of the Thick Portion]

The area ratio Ra is the ratio of the area of the thick portion T1 to the entire area the face surface. From the viewpoint of the strength of the face, the area ratio Ra is preferably equal to or greater than 5%, and more preferably equal to or greater than 7%. From the viewpoint of the rebound performance, the area ratio Ra is preferably equal to or less than 20%, and more preferably equal to or less than 18%. The area ratio Ra is calculated in the planar view.

[Tilt Angle θ]

In FIG. 8, the linear line L2 expresses the longest transverse line of the sloped thick portion Ts. The longest transverse line L2 is defined in the planar view. The longest transverse line L2 is a linear line passed through the thick portion center point Ec and having the longest transverse length. Two intersection points pt1 and pt2 can exist between the outline of the sloped thick portion Ts and the linear line (see FIG. 8). The distance between these two intersection points pt1 and pt2 is the transverse length. In the planar view, an angle formed between the horizontal direction and the linear line L2 is defined as the tilt angle θ. The horizontal direction is the direction of a linear line obtained by projecting a linear line along the toe-heel direction onto the projection plane Ps.

In the set 2, the tilt angle θ of the sloped thick portion Ts is greater as the club length is shorter. With this configuration, as the entire set, the flight distance performance can be improved. The hitting point distribution is changed as the club length is shorter. The tilt angle θ is changed as described above, so that the disposition of the thin portions tends to be fit to the hitting point distribution, and the flight distance can be increased.

An intermediate head between a wood type head and an iron type head is generally referred as a utility type head. The utility type head is sometimes referred to as a hybrid type head. A typical utility type head is hollow. Generally, the utility type head has both of the advantage of the wood and the advantage of the iron. Thus, this head preferably has an intermediate specification between the specification of the wood and the specification of the iron.

From the foregoing viewpoint, the lower limit of the head volume is preferably equal to or greater than 70 $cm^3$, more preferably equal to or greater than 80 $cm^3$, and still more preferably equal to or greater than 90 $cm^3$. The upper limit of the head volume is preferably equal to or less than 150 $cm^3$, more preferably equal to or less than 140 $cm^3$, and still more preferably equal to or less than 130 $cm^3$. The lower limit of the real loft angle is preferably equal to or greater than 15 degrees, more preferably equal to or greater than 16 degrees, and still more preferably equal to or greater than 17 degrees. The upper limit of the real loft angle is preferably equal to less than 32 degrees, more preferably equal to less than 30 degrees, still more preferably equal to less than 28 degrees, and yet more preferably equal to less than 26 degrees. The lower limit of the head width is preferably equal to or greater than 45 mm, more preferably equal to or greater than 50 mm, and still more preferably equal to or greater than 55 mm. The upper limit of the head width is preferably equal to or less than 120 mm, more preferably equal to or less than 100 mm, still more preferably equal to or less than 90 mm, and yet more preferably equal to or less than 80 mm. The head width is the maximum width of the head in the face-back direction. The lower limit of the head height TH (see FIG. 3) is preferably equal to or greater than 30 mm, more preferably equal to or greater than 32 mm, and still more preferably equal to or greater than 34 mm. The upper limit of the head height TH is preferably equal to or less than 42 mm, more preferably equal to or less than 40 mm, and still more preferably equal to or less than 37 mm.

A club including a utility type head is referred to as a utility type club. The club has both of the advantage of the wood and the advantage of the iron. From this viewpoint, the lower limit of the club length is preferably equal to or greater than 38.5 inches, and more preferably equal to or greater than 39 inches. The upper limit of the club length is preferably equal to or less than 41.5 inches, more preferably equal to or less than 41.25 inches, and still more preferably equal to or less than 41 inches.

It is noted that the club length is measured based on the golf rule of "1c. Length" in "1. Clubs" of "Appendix II. Design of Clubs" specified by R&A (Royal and Ancient Golf club of Saint Andrews).

EXAMPLES

In the following, the effects of the present invention will be clarified by examples. However, the present invention should not be interpreted in a limited way based on the description of the examples.

Example 1

Golf Club: U5

Ahead similar to the head 6 was prepared. The club number was U5. In the preparation of the face member 6*p*, flat plate rolled material was used. In the face member 6*p*, CNC processing was applied to the back surface of rolled material. Subsequently, the material was bent after subjected to CNC processing. A highly accurate thickness distribution was formed by CNC processing. The head main body 6*m* was prepared by lost-wax precision casting. The face member 6*p* was welded to the head main body 6*m*, the surface was polished, and the head was obtained. This head was mounted on one end portion of a commercially available carbon shaft. A grip was mounted on the other end portion of this shaft. In this manner, the club illustrated in FIG. 1 was obtained. The specification of the club was as follows.

The real loft angle: 23 degrees
The face height H1: 34.4 mm
The height H2 of the thick portion center point: 19.2 mm
The height H3: 13.5 mm
The height H4: 9.4 mm
H2/H1: 0.56
The tilt angle θ: 24.9 degrees
The thickness of the thick portion T1: 2.15 mm
The thickness of the heel thin portion: 1.5 mm
The thickness of the toe thin portion: 1.6 mm
The club length: 39.5 inches
The head volume: 111 cc

Comparative Example 1

Golf Club: U5

Figure 10:
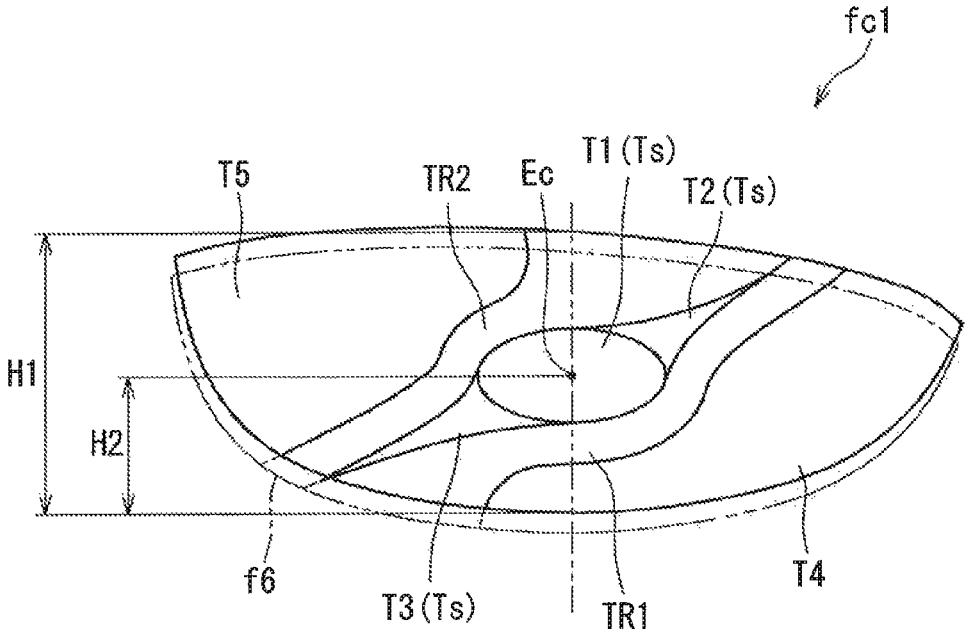
FIG. 10 is a planar view of a face according to comparative example 1.

FIG. 10 is the thickness distribution of a face fc1 according to comparative example 1. The thickness distribution according to comparative example 1 was obtained by shifting the thickness distribution of the face f6 according to example 1 overall 2 mm downward. The thickness distribution was obtained by changing the CAD data of CNC processing. The head and the club according to comparative example 1 were obtained in the same manner as in example 1 except above. The specification of the club was as follows.

The real loft angle: 23 degrees
The face height H1: 34.4 mm
The height H2 of the thick portion center point: 17.2 mm
H2/H1: 0.50
The tilt angle θ: 24.9 degrees
The thickness of the thick portion T1: 2.15 mm
The thickness of the heel thin portion: 1.5 mm
The thickness of the toe thin portion: 1.6 mm
The club length: 39.5 inches
The head volume: 111 cc

Comparative Example 2

Golf Club: U5

The thickness distribution of comparative example 2 was obtained by shifting the thickness distribution of the head according to example 1 overall 0.7 mm downward. The thickness distribution was obtained by changing the CAD data of CNC processing. The head and the club according to comparative example 2 were obtained in the same manner as in example 1 except above. The specification of the club was as follows.

The real loft angle: 23 degrees
The face height H1: 34.4 mm
The height H2 of the thick portion center point: 18.5 mm
H2/H1: 0.54
The tilt angle θ: 24.9 degrees
The thickness of the thick portion T1: 2.15 mm
The thickness of the heel thin portion: 1.5 mm
The thickness of the toe thin portion: 1.6 mm
The club length: 39.5 inches
The head volume: 111 cc

Example 2

Golf Club: U5

The thickness distribution of example 2 was obtained by shifting the thickness distribution of the head according to example 1 overall 0.3 mm downward. The thickness distribution was obtained by changing the CAD data of CNC processing. The head and the club according to example 2 were obtained in the same manner as in example 1 except above. The specification of the club was as follows.

The real loft angle: 23 degrees
The face height H1: 34.4 mm
The height H2 of the thick portion center point: 18.9 mm
H2/H1: 0.55
The tilt angle θ: 24.9 degrees
The thickness of the thick portion T1: 2.15 mm
The thickness of the heel thin portion: 1.5 mm
The thickness of the toe thin portion: 1.6 mm
The club length: 39.5 inches
The head volume: 111 cc

Comparative Example 3

Golf Club: U5

Figure 11:
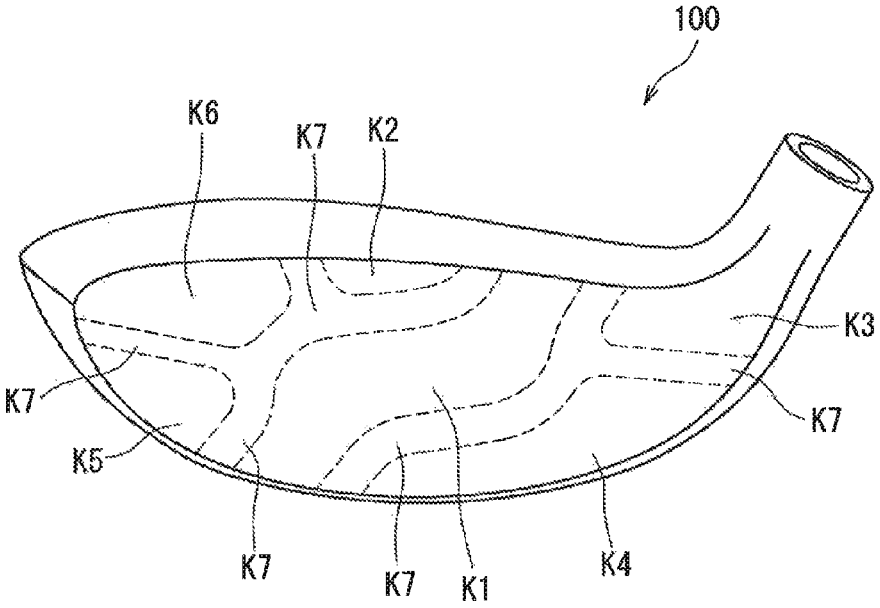
FIG. 11 is a perspective view of a head according to comparative example 3.
Figure 12:
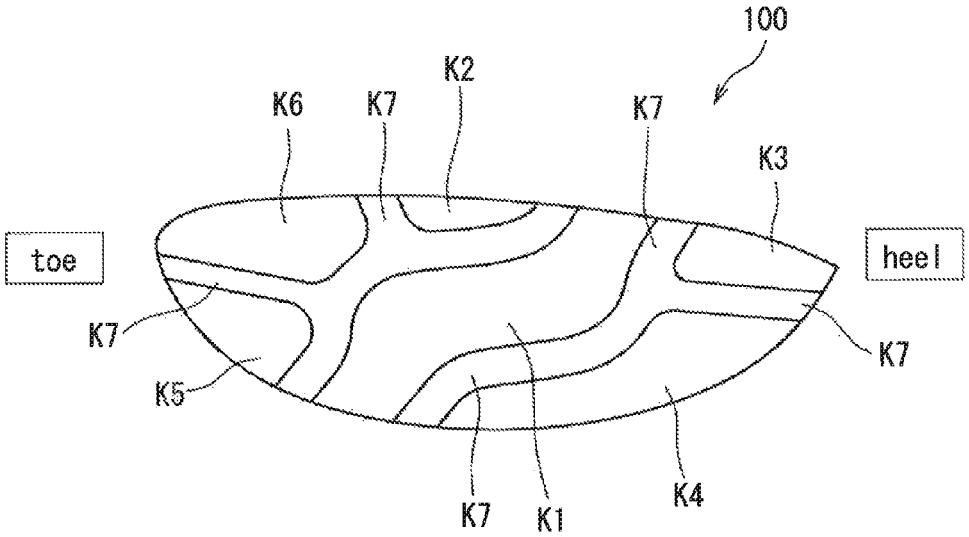
FIG. 12 is a planar view of a face according to comparative example 3.
Figure 13:
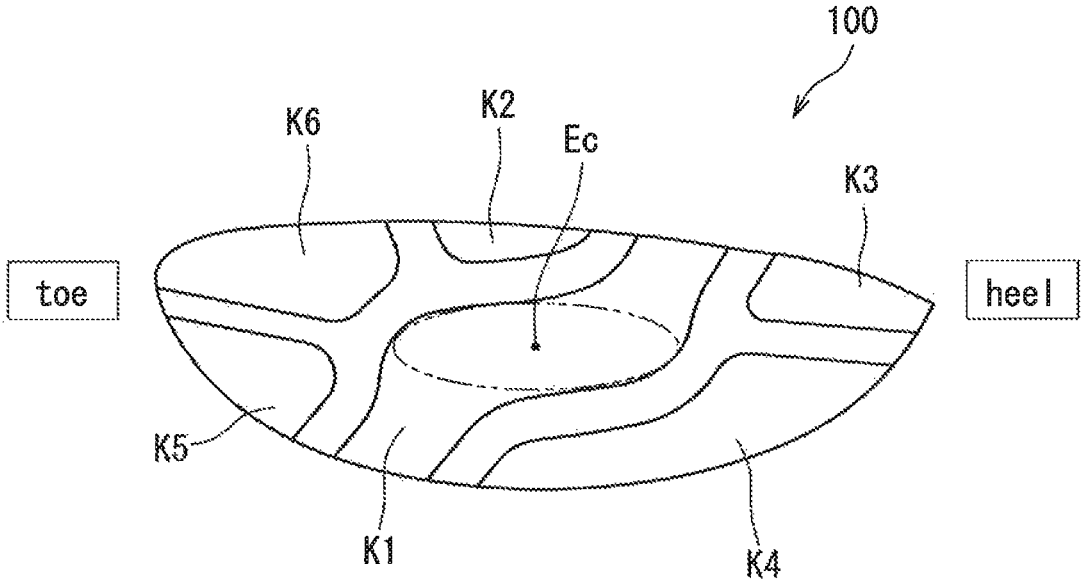
FIG. 13 shows a thick portion center point of the face according to comparative example 3.

FIG. 11 is a perspective view of a head 100 according to comparative example 3. FIG. 12 is a plan view of the thickness distribution of the head 100. FIG. 13 is a plan view that the thick portion center point Ec is added to FIG. 12.

The head 100 was prepared by casting. A cup-shaped face member was prepared by casting. Moreover, a head main body was prepared by casting. The face member was welded to the head main body. The surface of the welded head was polished, and the head 100 was obtained.

The face of the head 100 included a thick portion K1, a center upper portion K2, a heel upper portion K3, a heel lower portion K4, a toe lower portion K5, and a toe upper portion K6. A transitional portion K7 was provided between these portions. The thickness of the transitional portion K7 was gradually changed. The transitional portion K7 suppressed an abrupt change in the thickness. The entire face back surface was smoothly continued. The thicknesses of the portions were set as follows.

The thick portion K1: 2.4 mm
The center upper portion K2: 1.7 mm
The heel upper portion K3: 1.6 mm
The heel lower portion K4: 1.5 mm
The toe lower portion K5: 1.7 mm
The toe upper portion K6: 1.6 mm FIG. 13 is a view of the thick portion center point Ec of the head 100. The thick portion center point Ec was determined based on the definitions described above. In FIG. 13, a long dashed double-short dashed line expresses the maximum ellipse that can be inscribed in the thick portion in the planar view. The center of the ellipse is matched with the thick portion center point Ec.

The specification of the head 100 was as follows.
The real loft angle: 23 degrees
The face height H1: 31.8 mm
The height H2 of the thick portion center point: 16.8 mm
H2/H1: 0.53
The thickness of the thick portion T1: 2.4 mm
The thickness of the heel thin portion: 1.5 to 1.6 mm
The thickness of the toe thin portion: 1.6 to 1.7 mm
The club length: 39.5 inches
The head volume: 110 cc Example S1

Club Set: U3$^+$ to U6

A club set including the club according to example 1 was prepared. A method for manufacturing the clubs was the same method in example 1. In all the clubs, the thickness distribution of the face was the same as example 1. The club number of the clubs was 5. The club length was adjusted by changing on the length of the shaft. The specification of the obtained set is shown in Table 1 below.

[Table 1]

TABLE 1

Specification of Example S1

| | U3$^+$ | U3 | U4 | U5 | U6 |
|---|---|---|---|---|---|
| Real Loft Angle (degree) | 17 | 19 | 21 | 23 | 25 |
| Head Volume (cm$^3$) | 116 | 114 | 113 | 111 | 110 |
| Club Length (inch) | 41 | 40.5 | 40 | 39.5 | 39 |
| Club Weight (g) | 323 | 327 | 331 | 335 | 339 |
| Swing Balance | D0 | D0 | D0 | D0 | D0 |
| Tilt Angle θ | 18.85 | 20.85 | 22.85 | 24.85 | 26.85 |
| Face Height H1 (mm) | 33.0 | 33.4 | 33.8 | 34.4 | 34.9 |
| Height H2 (mm) | 18.5 | 18.7 | 18.9 | 19.2 | 19.5 |
| H2/H1 | 0.561 | 0.560 | 0.559 | 0.558 | 0.559 |

Comparative Example S1

Club Set: U3$^+$ to U6

A club set including the club according to comparative example 3 was prepared. A method for manufacturing the clubs was the same method in comparative example 3. In all the clubs, the thickness distribution of the face was the same as comparative example 3. The club number of the clubs was 5. The club length was adjusted by changing the length of the shaft. The specification of the obtained set is shown Table 2 below.

[Table 2]

TABLE 2

Specification of Comparative Example S1

| | U3$^+$ | U3 | U4 | U5 | U6 |
|---|---|---|---|---|---|
| Real Loft Angle (degree) | 17 | 19 | 21 | 23 | 25 |
| Head Volume (cm$^3$) | 112 | 111 | 110 | 110 | 109 |
| Club Length (inch) | 41 | 40.5 | 40 | 39.5 | 39 |
| Club Weight (g) | 323 | 327 | 331 | 335 | 339 |
| Swing Balance | D0 | D0 | D0 | D0 | D0 |
| Tilt Angle θ | — | — | — | — | — |
| Face Height H1 (mm) | 30.6 | 30.9 | 31.3 | 31.8 | 32.3 |
| Height H2 (mm) | 16.5 | 16.6 | 16.5 | 16.8 | 17.1 |
| H2/H1 | 0.539 | 0.537 | 0.527 | 0.528 | 0.529 |

[Evaluated Result]

[Flight Distance]

Tests for actually hitting balls were conducted in a test center having the lawn field similar to golf courses. A ball was placed on the lawn in fairway, and a golf player hit the ball. Tests were conducted by ten testers whose handicap was 10 or greater and 20 or less. "XXIO XD-AERO" (trade name) made by DUNLOP SPORTS CO. LTD. was used as the ball. Each of the golf players shot five times with each of the clubs. The flight distances were measured for each shot. The mean value of all the shots was calculated.

The average flight distances of the clubs were as follows.
Example 1: 155 yards
Example 2: 153 yards
Comparative example 1: 151 yards
Comparative example 2: 152 yards
Comparative example 3: 150 yards The average flight distances of the sets were as follows. The average flight distance of the set was defined as the mean value of the flight distances of five clubs (U3$^+$ *to U*6).
Example S1: 165 yards
Comparative example S1: 161 yards As described above, the evaluations of the examples are higher than those of the comparative examples. The superiority of the present invention is apparent.

The present invention is applicable to a wood type head, a utility type head, a hybrid type head, and the like.

The foregoing description is examples only, and can be modified variously in the scope not deviating from the nature of the present invention.

What is claimed is:

1. A golf club comprising a hollow head, a shaft, and a grip, wherein:

the head includes a face having a central part, a heel-side part closer to the shaft than the central part, and a toe-side part farther from the shaft than the central part;

the face further includes a central thick portion disposed within the central part and having a center point within the central part, a heel-side thick portion with a thickness thinner than the central thick portion and disposed at an upper part of the heel-side part, a toe-side thick portion with a thickness thinner than the central thick portion and disposed at a lower part of the toe-side part, and one or more thin portions disposed outside the heel-side, central, and toe-side thick portions and having a thickness thinner than all of these portions, wherein the heel-side, central, and toe-side thick portions taken together comprise a sloped thick portion extending from the upper part of the heel-side part to the lower part of the toe-side part;

if the total height of the face at the central thick portion center point is defined as H1 and the height of the central thick portion center point from the face bottom is defined as H2, then H2/H1 is equal to or greater than 0.55 and equal to or less than 0.63; and the ratio of the sloped thick portion area with respect to the entire area of the face is equal to or less than 20%.

2. The golf club according to claim 1, wherein:

the head is formed by joining a head main body to a face member;

the face member is formed from a rolled material; and the face member back surface is subjected to NC processing.

3. The golf club according to claim 2, wherein the face member is bent after being subjected to the NC processing.

4. The golf club according to claim 1, wherein:

the head has a head volume of 70 $cm^3$ or greater and 150 $cm^3$ or less; and the head has a real loft angle of 15 degrees or greater and 32 degrees or less.

5. The golf club according to claim 1, wherein:

the face further includes one or more transitional portions located between the sloped thick portion and the thin portion or portions; and the transitional portion or portions connect the sloped thick portion to the thin portion or portions without a step.

6. The golf club according to claim 1, wherein, the heel-side thick portion and the toe-side thick portion each extend continuously to the central thick portion.

7. The golf club according to claim 6, wherein:

the toe-side part includes a toe-side thin portion disposed in a upper portion with a thickness that is thinner than the toe-side thick portion and a toe-side transitional portion connecting the toe-side thin and thick portions, and having a thickness gradually increasing from the toe-side thin to thick portions without a step; and the heel-side part includes a heel-side thin portion disposed in a lower portion with a thickness that is thinner than the heel-side thick portion and a heel-side transitional portion connecting the heel-side thin and thick portions, and having a thickness gradually increasing from the heel-side thin to thick portions without a step.

8. The golf club according to claim 6, wherein, the toe-side and heel-side thick portions each decrease in width as each extends from the central thick portion to the toe-side part and heel-side part, respectively.

9. The golf club according to claim 1, wherein the height of the face is equal to or less than 40 mm.

10. The golf club according to claim 1, wherein the distance from the face bottom to the center point of the central thick portion is equal to or less than 22 mm.

11. The golf club according to claim 1, wherein the distance from the face bottom to the bottom of the central thick portion is equal to or less than 7 mm.

12. The golf club according to claim 1, wherein the distance from the head bottom to the head top is equal to or less than 42 mm.

13. The golf club according to claim 1, wherein the ratio of (1) the distance from the face bottom to the bottom of the central thick portion to (2) the distance from the face top to the top of the central thick portion is equal to or greater than 1.0.

14. The golf club according to claim 1, wherein the head has a volume of 70 $cm^3$ or greater and 150 $cm^3$ or less.

15. The golf club according to claim 1, wherein the loft angle of the face is 15 degrees or greater and 32 degrees or less.

16. A golf club set comprising a plurality of golf clubs different in club length, wherein:

each of the golf clubs includes a hollow head, a shaft, and a grip;

each of the heads includes a face; and the face has a central part, a heel-side part closer to the shaft than the central part, and a toe-side part farther from the shaft than the central part;

the face further includes a central thick portion disposed within the central part and having a center point within the central part, a heel-side thick portion with a thickness thinner than the central thick portion and disposed at an upper part of the heel-side part, a toe-side thick portion with a thickness thinner than the central thick portion and disposed at a lower part of the toe-side part, and one or more thin portions disposed outside the heel-side, central, and toe-side thick portions and having a thickness thinner than all of these portions, wherein the heel-side, central, and toe-side thick portions taken together comprise a sloped thick portion extending from the upper part of the heel-side part to the lower part of the toe-side part;

if the total height of the face at the central thick portion center point is defined as H1 and the height of the central thick portion center point from the face bottom is defined as H2, then H2/H1 is equal to or greater than 0.55 and equal to or less than 0.63; and the ratio of the sloped thick portion area with respect to the entire area of the face is equal to or less than 20%.

17. A golf club set comprising a plurality of golf clubs different in club length, wherein:

each of the golf clubs includes a hollow head, a shaft, and a grip;

each of the heads includes a face; and the face has a central part, a heel-side part closer to the shaft than the central part, and a toe-side part farther from the shaft than the central part;

the face further includes a central thick portion disposed within the central part and having a center point within the central part, a heel-side thick portion with a thickness thinner than the central thick portion and disposed at an upper part of the heel-side part, a toe-side thick portion with a thickness thinner than the central thick portion and disposed at a lower part of the toe-side part, and one or more thin portions disposed outside the heel-side, central, and toe-side thick portions and having a thickness thinner than all of these portions, wherein the heel-side, central, and toe-side thick portions taken together comprise a sloped thick portion extending from the upper part of the heel-side part to the lower part of the toe-side part;

if the total height of the face at the central thick portion center point is defined as H1 and the height of the central thick portion center point from the face bottom is defined as H2, then H2/Hl is equal to or greater than 0.55 and equal to or less than 0.63;

the heel-side thick portion and the toe-side thick portion each extend continuously to the central thick portion; and the sloped thick portion has a slope from the toe-side thick portion to the heel-side thick portion corresponding to a tilt angle θ that increases as the club length becomes shorter.

* * * * *